United States Patent [19]

Heinz et al.

[11] 4,329,738

[45] May 11, 1982

[54] COVER FOR MOTOR VEHICLE LIGHTS

[75] Inventors: Werner Heinz, Tiefenbronn; Adolf Schmidt, Sindelfingen; Arno Jambor, Vaihingen, all of Fed. Rep. of Germany

[73] Assignee: Daimler-Benz Aktiengesellschaft, Stuttgart, Fed. Rep. of Germany

[21] Appl. No.: 124,262

[22] Filed: Feb. 25, 1980

[30] Foreign Application Priority Data

Feb. 24, 1979 [DE] Fed. Rep. of Germany ..... 2907286

[51] Int. Cl.[3] ..... F21V 5/04; F21V 13/00

[52] U.S. Cl. ..... 362/61; 362/309; 362/328

[58] Field of Search ..... 362/61, 80, 300, 307, 362/308, 309, 311, 326, 327, 337, 339, 367, 328

[56] References Cited

U.S. PATENT DOCUMENTS

| | | | |
|---|---|---|---|
| 1,557,563 | 10/1925 | Dahlstrom | 362/337 |
| 2,283,598 | 5/1942 | Decalion | 362/309 |
| 4,153,928 | 5/1979 | Speedy | 362/80 |

*Primary Examiner*—L. T. Hix
*Assistant Examiner*—Alan Mathews
*Attorney, Agent, or Firm*—Craig and Antonelli

[57] ABSTRACT

A cover for lights, especially automobile lights, wherein at least a part of the cover which is located within a flat area of a reflector opening of the light when the cover is installed is provided with a number of individual sections. The sections are staggered in a stepwise fashion within a plane which is horizontal in the installed position and/or in a vertical plane with the sections extending in a direction opposite to an intended direction of travel of the atuomobile.

20 Claims, 4 Drawing Figures

COVER FOR MOTOR VEHICLE LIGHTS

The present invention relates to a cover, and, more particularly, to a cover for motor vehicles lights.

With the present development of motor vehicles and the trend toward providing an increased tapering and slanting streamlined shape for motor vehicle bodies, it is necessary to adapt the lights integrated in the front part of the vehicle to the sloping or slanting design not only for stylistic reasons but also for aerodynamic reasons. However, such adaptation of vehicle lights to the motor vehicle body is impossible with the existing designs and constructions of vehicle light covers.

The aim underlying the present invention essentially resides in providing a cover for lights, especially automobile lights, which cover conforms to stylistic and aerodynamic requirements for sloping, streamlined shapes of motor vehicles.

In accordance with the present invention, a cover for lights is provided wherein at least part of the cover is located within an area of a reflector opening of the light when the light is covered by the cover, with such part being provided with individual sections which are staggered in a stepwise fashion within a plane which is horizontal in the installed position and/or in a vertical plane and against an intended direction of travel with essentially parallel displacement with respect to one another.

By virtue of the stepped construction of the present invention, it is possible for the lights to be integrated in the front part of the motor vehicle with the cover conforming to stylistic and aerodynamic requirements for sloping, streamlined shapes, while causing only a relatively insignificant loss of light.

In accordance with further advantageous features of the present invention, the sections of the cover may be placed at an angle relative to the reference plane at right angles to the optical axis of the light, at a horizontal angle to the horizontal plane, and at a vertical angle to the vertical plane.

By mounting the segments of the cover at an angle within the horizontal plane and/or vertical plane, a sharper taper is possible. As can readily be appreciated, the size of the horizontal angle and vertical angle is predetermined by the optical characteristics of the light available at the time.

Advantageously, in accordance with the present invention, the sum of the vertical and horizontal angles is on the order of approximately 40 degrees or less; however, this sum is in no way compulsory since the cover of the present invention may be utilized with lights having different optical characteristics. In this connection, the limit of the size of the horizontal angle and vertical angle of a diagonal position is located at a point where excessive taper, for light engineering reasons, leads to possible disadvantages such as, for example, losses or distortion of the light.

In accordance with the present invention, the individual sections of the cover may be integrally formed with one another and with the other part of the cover; however, it is also possible to provide sections of the cover which consist of strips or plates which are independent materialwise and are connected tightly together in the stepped transition area by shaped pieces.

According to the present invention, the shaped parts connecting the independent sections together may have an approximately S-shaped cross section whereby one half of the cross section of the S accepts a section and the other half of the cross section of the S accepts the next section in the stepped arrangement.

It is also possible according to the present invention for the shaped parts to have an approximately L-shaped cross section with a rib located at a distance from a shorter leg of the L and approximately parallel thereto but projecting in the opposite direction from the longer leg of the L whereby the shorter leg of the L and adjacent section of the longer leg of the L abut an edge of a section and rib and the adjacent other part of the longer leg of the L abut the edge of the next section in a stepped arrangement.

Preferably, in accordance with the present invention, the shaped parts are made of a transparent material such as a plastic or glass. Likewise, the respective sections of the cover are also made of a transparent material such as, for example, glass.

Additionally, the sections that cover the present invention may be assembled in an approximately-faceted manner relative to one another. It is to be understood the scope of the present invention includes any number or shape of segments stepped in the horizontal and/or vertical plane. Moreover, the cover construction in accordance with the present invention is suitable for both headlights and other lights of a motor vehicle such as, for example, fog lights.

Accordingly, it is an object of the present invention to provide a cover member for motor vehicle lights which avoids, by simple means, shortcomings and disadvantages encountered in the prior art.

Another object of the present invention resides in providing a cover for motor vehicle lights which conforms to stylistic and aerodynamic requirements for sloping, streamlined shapes of the motor vehicle.

A further object of the present invention resides in providing a cover for motor vehicle lights which enables only a relatively-insignificant loss of light.

These and other objects, features and advantages of the present invention will become more apparent from the following description when taken in connection with the accompanying drawings which show, for the purposes of illustration only, several embodiments in accordance with the present invention, and wherein.

Figure 1:
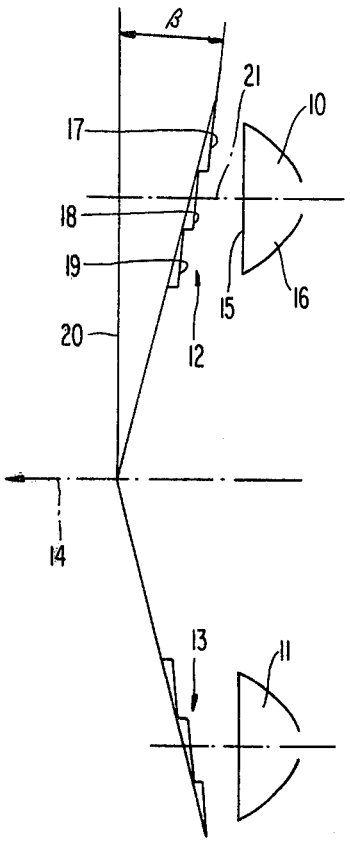
FIG. 1 is a schematic view within a horizontal plane of two motor vehicles lights having associated therewith an installed cover in accordance with the present invention.

Referring now to the drawings, wherein like reference numerals are used through the various views to designate like parts, and, more particularly, to FIG. 1, according to this figure, a cover generally designated by the reference numeral 12 or 13 is installed forwardly of each motor vehicle light 10,11 with both covers 12,13 being tapered within a horizontal plane in a direction of travel indicated by the arrow 14 so as to produce more streamlined shapes in a vicinity of the front of the vehicle.

While the specific details of the special construction of the light covers described in greater detail hereinbelow refers only to the cover 12 in FIG. 1, it is understood that such details are also applicable to the cover 13 disposed at the other light of the vehicle. More particularly, at least a part of the cover 12 which is located adjacent an opening of the reflector 16 when the cover is in an installed position, is subdivided into individual parts 17,18,19. The individual parts 17,18,19 are staggered in a staircase fashion and stepped back with respect to each other opposite to the direction of travel indicated by the arrow 14, with essentially-parallel staggering. The individual parts or sections 17,18,19 are mounted at an angle relative to a reference plane 20 which is illustrated as being at right angles to an optical axis 21 of the light and at an angle $\beta$ within the horizontal plane. The angle $\beta$ is selected so that the staggering of the individual parts or sections 17,18,19 produces practically zero light losses.

Figure 2:
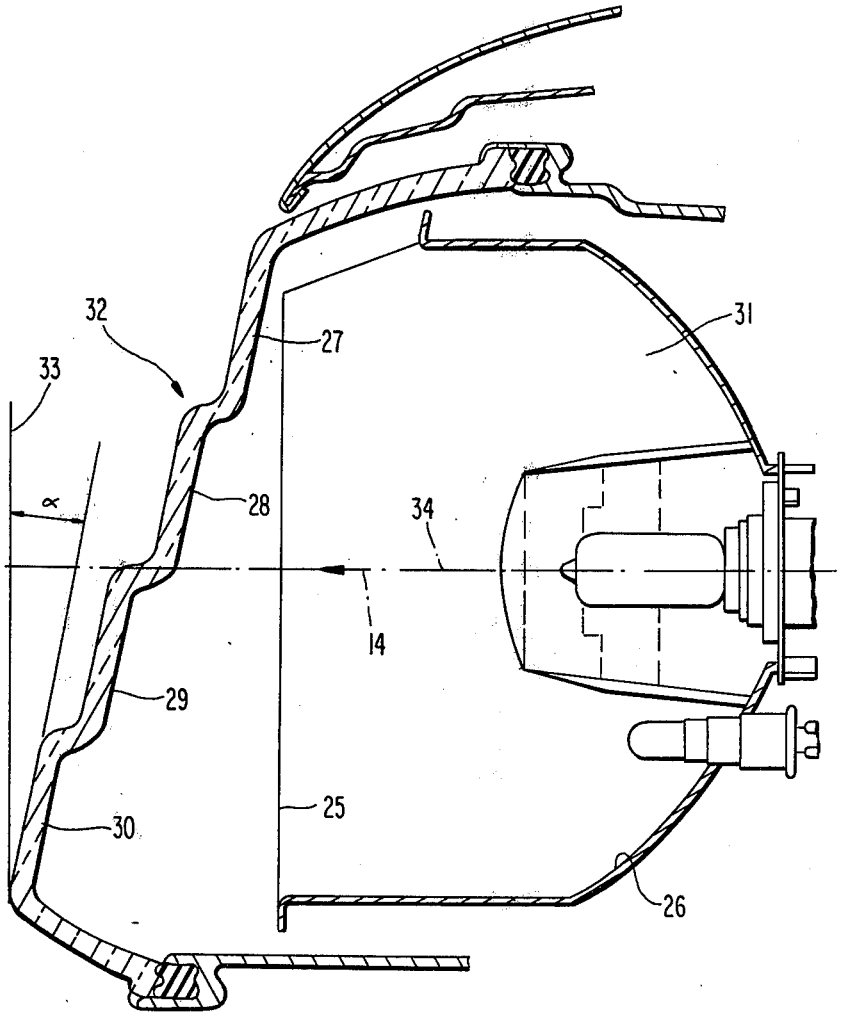
FIG. 2 is a partially-schematic, cross-sectional view within a vertical plane of a cover in accordance with a first embodiment of the present invention installed at a motor vehicle light.
Figure 3:
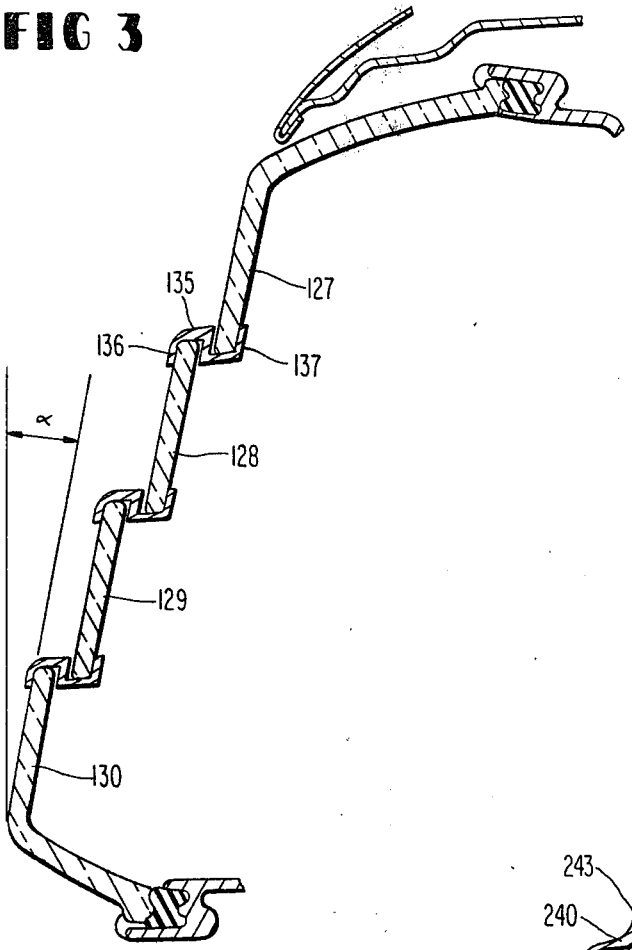
FIG. 3 is a partially-schematic, cross-sectional view within a vertical plane of a cover in accordance with a second embodiment of the present invention installed at a motor vehicle light.
Figure 4:
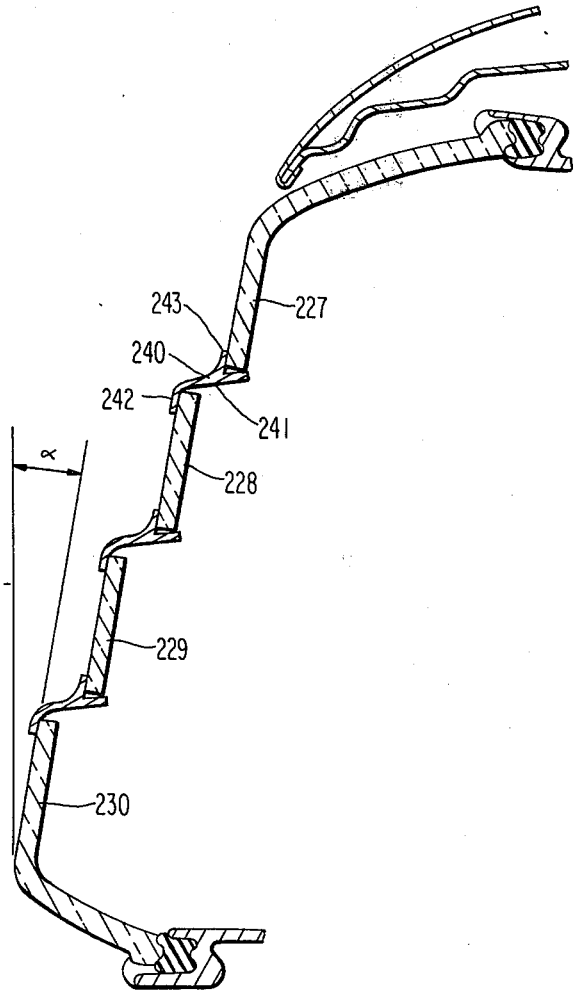
FIG. 4 is a partially-schematic, cross-sectional view within a vertical plane of a cover in accordance with a third embodiment of the present invention installed at a motor vehicle light.

The above-described stepping or staggering, viewed within the horizontal plane, which plane coincides with the plane of the drawing in FIG. 1, also may have a similar stepping superimposed upon it within a vertical plane in the installed position, or such a stepping or staggering can be provided instead within the horizontal plane as shown in FIG. 1 with the latter being shown in the various embodiments illustrated in FIGS. 2–4.

As shown in FIG. 2, a cover generally designated by the reference numeral 32 is provided for a light 31. The cover 32 is shown in the plane which is vertical in the installed position, and, as may be seen, at least a part of the cover 32, located within an area 25 of an opening of the reflector 26 of the light 31 when the light 31 is covered, has within the vertical plane individual sections 27,28,29,30 which are staggered staircase fashion and stepped back with respect to one another in a direction opposite to an intended direction of travel indicated by the arrow 14 with essentially-parallel displacement. The sloping position of the sections 27,28,29,30 is relative to a reference plane 33 which is approximately at right angles to the optical axis 34 of the light 31 and at an angle $\alpha$ to the vertical plane.

As shown in FIG. 2, the sections 27,28,29,30 are integral with one another and with the remaining part of the cover 32; therefore, the sections 27,28,29,30 merge with one another in an integral fashion by stepped ribs between them. The sections 27,28,29,30 are arranged in a facet-like arrangement with respect to one another and the entire cover 32 consists of a transparent material, such as, for example, glass.

In FIG. 3, a cover generally designated by the reference numeral 132 is provided which includes a plurality of sections 127,128,129,130 which sections are made of strips or plates which are independent from each other and which are connected tightly together in a transition area between the steps by special shaped sections 135.

The shaped sections 135, as shown in FIG. 3, are approximately S-shaped in cross section with one transverse half 136 of the S accepting one section 128 and the other transverse half 137 of the S accepting the next section 127 in a stepped arrangement. The fit between the shaped sections 135 and the sections 127,128,129,130 of the cover is firm and tight resulting in an overall firm connection of the individual sections 127,128,129,130 with one another.

As shown in FIG. 4, a cover generally designated by the reference 232 is provided which includes a plurality of sections 227,228,229,230 which are made of strips or plates which are independent and which are connected tightly together by special shaped sections or elements 240. The elements 240 have an approximately L-shaped cross-sectional configuration including a long leg 241 and a short leg 242. On the long leg 241 of the L-shaped elements 240, at a distance from the shorter leg 242, a rib 243 is provided which is essentially parallel to the shorter leg 242 but is reinforced in the opposite direction. The shorter leg 242 and adjacent section of the longer leg 241 abut the edge of one section 228 while the rib 243 and the adjacent other section of the longer leg 241 abut the edge of the next section 227 in a stepped or staggered arrangement.

The shaped parts or elements 135 and 240 in FIGS. 3 and 4 may be made of a sheet of transparent material such as, for example, plastic or glass. The sections 127,128,129,130, as well as the sections 227,228,229,230 which abut one another in a faceted manner, are made of a transparent material such as, for example, glass.

A determination of the horizontal slope angle $\beta$ (FIG. 1) and the vertical angle $\alpha$ (FIGS. 2–4) is accomplished essentially on the basis of optical data. Preferably, the sum of the angles $\alpha+\beta$, for given optical values, must be 40 degrees or less; however, as can be appreciated, changes in such sum do not fall within the scope of the present invention.

While the invention has been described in connection with an application to headlights of a motor vehicle, it is understood that the same advantages could be obtained by the present invention for fog lights or other lights of motor vehicles.

As a result of a cover constructed in accordance with the present invention, when such cover is installed on motor vehicles, the tendency toward increasing the taper and sloping streamlined shapes is taken into account by light design.

While we have shown and described only one embodiment in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

What is claimed is:

1. A cover for a headlight with a reflector, with a cover part which is stepped and overlaps at least the reflector, said part comprising sections staggered parallel to one another and stepped back opposite to a longitudinal axis of the vehicle, characterized by the fact that the stepping of parts runs in at least one plane which is one of horizontal and vertical in the installation position, is somewhat like a staircase, and runs in said plane monotonically from one side of the cover part to the opposite side, whereby in the installed position, the side of the cover part which projects farthest in the direction of the longitudinal axis in the horizontal plane has sections having light passing planes which contain positionally corresponding points which lie on lines which are directed in the direction of the longitudinal axis and also towards the center of the vehicle, and in the vertical plane to the lowest side of the vehicle, and by the fact that parts are positioned diagonally rearward in the installed position and inclined inward toward the reflector, and in the plane which is one of a horizontal plane in the installed position to form an acute azimuth angle $\beta$ and a plane which is vertical in the installation position to form an acute elevation angle $\alpha$ with a reference plane which is at right angles to an optical headlight axis.

2. A cover for a headlight in accordance with claim 1, wherein each of said light passing planes is disposed so that a line normal to the surface thereof is directed generally in the direction of the longitudinal axis and at an acute angle with respect thereto and upwards in a vertical plane.

3. A cover according to claim 1, characterized in that a sum of the horizontal angle $\beta$ and the vertical angle $\alpha$ is equal to approximately 40 degrees or less.

4. A cover according to claim 3, characterized in that the individual sections are integrally formed with one another and with other parts of the cover.

5. A cover according to claim 3, characterized in that the individual sections are formed as one of independent strip members or plate members, and in that means are provided for tightly connecting adjoining members to each other in a stepped transition area between the adjoining members.

6. A cover according to claim 5, characterized in that the connecting means includes an S-shaped part disposed between adjoining members, said S-shaped part being arranged such that one of the adjoining members is accommodated in one half of the S-shaped part and the other of the adjoining members is accommodated in the other half of the S-shaped part.

7. A cover according to claim 5, characterized in that the connecting means includes an L-shaped part having a long and short leg, a rib is provided on the long leg at a position spaced from the short leg, the rib extends in a direction approximately parallel to the short leg and in a direction opposite from the short leg, and in that the L-shaped member is disposed between adjoining members so that the short leg and an adjoining portion of the long leg abut an edge of one of the adjoining members and the rib and an adjoining portion of the long leg abut an edge of the other of the adjoining members in a stepped fashion.

8. A cover according to one of claims 6 or 7, characterized in that the shaped parts are made of a transparent material.

9. A cover according to claim 8, characterized in that the transparent material is one of plastic or glass.

10. A cover according to claim 8, characterized in that the members forming the individual sections are made of a transparent material.

11. A cover according to claim 10, characterized in that the transparent material of the individual sections is glass.

12. A cover according to claim 11, characterized in that the transparent material of the shaped parts is one of glass or plastic.

13. A cover according to claim 1 characterized in that the individual sections are assembled in an approximately-faceted manner relative to one another.

14. A cover according to claim 1, characterized in that the individual sections are integrally formed with one another and with other parts of the cover.

15. A cover according to claim 1, characterized in that the individual sections are formed as one of independent strip members or plate members, and in that means are provided for tightly connecting adjoining members to each other in a stepped transition area between the adjoining members.

16. A cover according to claim 15, characterized in that the connecting means includes an S-shaped part disposed between adjoining members, said S-shaped part being arranged such that one of the adjoining members is accommodated in one half of the S-shaped part and the other of the adjoining members is accommodated in the other half of the S-shaped part.

17. A cover according to claim 15, characterized in that the connecting means includes an L-shaped part having a long and short leg, a rib is provided on the long leg at a position spaced from the short leg, the rib extends in a direction approximately parallel to the short leg and in a direction opposite from the short leg, and in that the L-shaped member is disposed between adjoining members so that the short leg and an adjoining portion of the long leg abut an edge of one of the adjoining members and the rib and an adjoining portion of the long leg abut an edge of the other of the adjoining members in a stepped fashion.

18. A cover according to claim 1 characterized in that the individual sections are made of a transparent material.

19. A cover part for a vehicle headlight with an optical axis, said headlight having a reflector, said part comprising sections, each section having a plane passing light substantially in a direction of a longitudinal axis of the vehicle, said planes being parallel to one another and stepped back opposite to the longitudinal axis, characterized by the fact that the stepping of sections runs monotomically from one side of the cover part to the opposite side in at least one plane which is at least one of a horizontal plane and a vertical plane in the installation position, and whereby in the installed position, the side of the cover part which projects farthest in the direction of the longitudinal axis in the horizontal plane has sections, said light passing planes of which lie on lines which point in the direction of the longitudinal axis and also towards the center of the vehicle, and the side of the cover part which projects farthest in the direction of the longitudinal axis in the vertical plane has sections, said light passing planes of which contain positionally corresponding points which lie on lines which are directed in the direction of the longitudinal axis and also towards the lowest side of the vehicle, and by the fact that, with respect to the direction of the longitudinal axis, the light passing planes of said sections are positioned diagonally rearward in the installed position and inclined toward the reflector, and positioned with respect to a reference plane which is at right angles to the optical axis to form at least one of an acute horizontal angle $\beta$ with apex toward the center of the vehicle and an acute vertical angle $\alpha$ with apex toward the lower side of the vehicle.

20. A cover according to claim 19, wherein the said planes of said sections are positioned with respect to the reference plane which is at right angles to the optical axis to form both an acute horizontal angle $\beta$ with apex toward the center of the vehicle and an acute vertical angle $\alpha$ with apex toward the lower side of the vehicle.

* * * * *